US007827619B1

(12) United States Patent
Steinberg et al.

(10) Patent No.: US 7,827,619 B1
(45) Date of Patent: Nov. 9, 2010

(54) REMOVABLE RESISTANT GARMENT

(76) Inventors: Michael R. Steinberg, 1034 Wheatland Dr., Crystal Lake, IL (US) 60014; Kristin L. Steinberg, 1034 Wheatland Dr., Crystal Lake, IL (US) 60014

( * ) Notice: Subject to any disclaimer, the term of this patent is extended or adjusted under 35 U.S.C. 154(b) by 459 days.

(21) Appl. No.: 11/872,078

(22) Filed: Oct. 15, 2007

(51) Int. Cl.
*A41D 10/00* (2006.01)
*A41D 11/00* (2006.01)

(52) U.S. Cl. ..... 2/114; 2/75

(58) Field of Classification Search ..... 2/69, 2/114, 79, 75, 80, 111
See application file for complete search history.

(56) References Cited

U.S. PATENT DOCUMENTS

| | | | | | |
|---|---|---|---|---|---|
| 2,588,542 | A * | 3/1952 | Kunz | 2/80 |
| 4,773,101 | A | 9/1988 | Kapp et al. | |
| 4,853,977 | A * | 8/1989 | Foreman | 2/114 |
| 5,048,122 | A * | 9/1991 | Prieur | 2/69 |
| 5,058,208 | A * | 10/1991 | Adams | 2/80 |
| 5,084,914 | A * | 2/1992 | Hesch | 2/79 |
| 5,208,918 | A * | 5/1993 | Royal | 2/114 |
| 5,418,978 | A * | 5/1995 | Hochman | 2/69 |
| 5,713,373 | A * | 2/1998 | Argentino | 128/869 |
| 5,911,312 | A | 6/1999 | Holyfield | |
| D438,364 | S * | 3/2001 | Knoefel | D2/714 |
| 6,260,200 | B1 * | 7/2001 | Alfred | 2/69 |
| 7,305,717 | B1 * | 12/2007 | Brown | 2/114 |
| 2007/0250985 | A1 * | 11/2007 | Harris et al. | 2/111 |
| 2008/0000005 | A1 * | 1/2008 | Rogerson et al. | 2/111 |
| 2009/0293169 | A1 * | 12/2009 | Wise | 2/80 |

* cited by examiner

*Primary Examiner*—Alissa L Hoey

(57) ABSTRACT

A removable resistant garment includes a garment, a zipper flap, a safety flap and a rear mounted zipper. The garment includes an abdomen section and two leg sections. The garment may also include two arm sleeves. A rear of the abdomen section is preferably split down substantially a middle thereof. One of the two leg sections may also be split the entire length thereof. A zipper is used to joint a slit in the abdomen and one of the leg sections. One end of the zipper flap is attached to one side of the abdomen slit and the other end is removably attachable to the other side of the abdomen slit. One end of the safety flap is attached to the one side of the abdomen slit and the other end is removably attachable to the other side of the abdomen split. The safety flap covers the zipper flap.

1 Claim, 3 Drawing Sheets

REMOVABLE RESISTANT GARMENT

BACKGROUND OF THE INVENTION

1. Field of the Invention

The present invention relates generally to toddler garments and more specifically to a removable resistant garment, which makes it extremely difficult for a toddler to remove a garment they are wearing.

2. Discussion of the Prior Art

U.S. Pat. No. 2,888,009 to Taylor discloses an infant's sleeping bag. The Taylor patent includes an infant's sleeping bag, which gives the infant freedom of body movement. The Taylor invention also provides the utmost comfort, and affords softness and a safe fit around an infant's neck. U.S. Pat. No. 4,773,101 to Kapp et al. discloses a baby robe. The Kapp patent includes an article of clothing of adjustable length with front and rear panels defining an open body portion with or without arms, a pair of legs; and a drawstring in each leg of the front and rear panels for varying the length of the legs.

U.S. Pat. No. 5,911,312 to Holyfield discloses protective clothing for elderly and infirm patients. The Holyfield patent includes clothing without any front entry and with a rear entry slit that has one or more protective flaps, which cover and protect a fastener from manipulation by the patient. The garment preferably has an elongated zipper running vertically along the center of the rear.

Accordingly, there is a clearly felt need in the art for a removable resistant garment, which includes a zipper flap to prevent a zipper tab from being unzipped and a safety flap for cushioning any sensation from the zipper tab, when the wearer is laying on their back.

SUMMARY OF THE INVENTION

The present invention provides a removable resistant garment, which makes it extremely difficult for a toddler to remove the garment they are wearing. The removable resistant garment includes a garment, a zipper flap, a safety flap and a rear mounted zipper. The garment includes an abdomen section, a right leg section and a left leg section. A neck opening is formed through a top of the abdomen section. The right and left leg sections extend from a bottom of the abdomen section. The garment may also include a left arm sleeve and a right arm sleeve. The left arm sleeve extends from a left side of the garment, adjacent a top of the abdomen section and the right arm sleeve extends from a right side of the garment, adjacent a top of the abdomen section. A crouch area is located between an inner surface of the left leg section, an inner surface of the right leg section and a bottom of the abdomen section.

An abdomen slit is preferably formed substantially down a middle of the abdomen section in a rear thereof. A leg slit may be formed down an entire length of one of the two leg sections. A rear mounted zipper is used to joint the slit in the abdomen and one of the leg sections. A zipper tab of the rear mounted zipper is located at substantially the neck opening. One end of the zipper flap is attached to one side of the abdomen slit and a first male snap is secured to the other side of the abdomen slit. A first female snap is retained in the other end of the zipper flap. The zipper flap is located, under the zipper tab, such that the zipper tab prevents the rear mounted zipper from being unzipped. A person wearing the garment will not be able to slide the zipper tab below the zipper flap, without detaching the zipper flap. One end of the safety flap is attached to the one side of the abdomen split. A second male snap is located below the first male snap and a third male snap is located above the first male snap. Second and third female snaps are retained in the other end of the safety flap, such that they engage the second and third male snaps. The safety flap covers the zipper flap, when the second and third female and male snaps are engaged with each other. The safety flap prevents the person from "feeling" the zipper tab when they are laying on their back.

Accordingly, it is an object of the present invention to provide a removable resistant garment, which includes a zipper flap to prevent a zipper from being unzipped.

It is a further object of the present invention to provide a removable resistant garment, which includes a safety flap that provides an extra barrier for preventing the wearer from taking-off the removable resistant garment.

Finally, it is another object of the present invention to provide a removable resistant garment, which includes a safety flap that makes the wearer less aware that there is a zipper tab and a zipper flap, while laying on their back.

These and additional objects, advantages, features and benefits of the present invention will become apparent from the following specification.

DETAILED DESCRIPTION OF THE PREFERRED EMBODIMENTS

Figure 1:
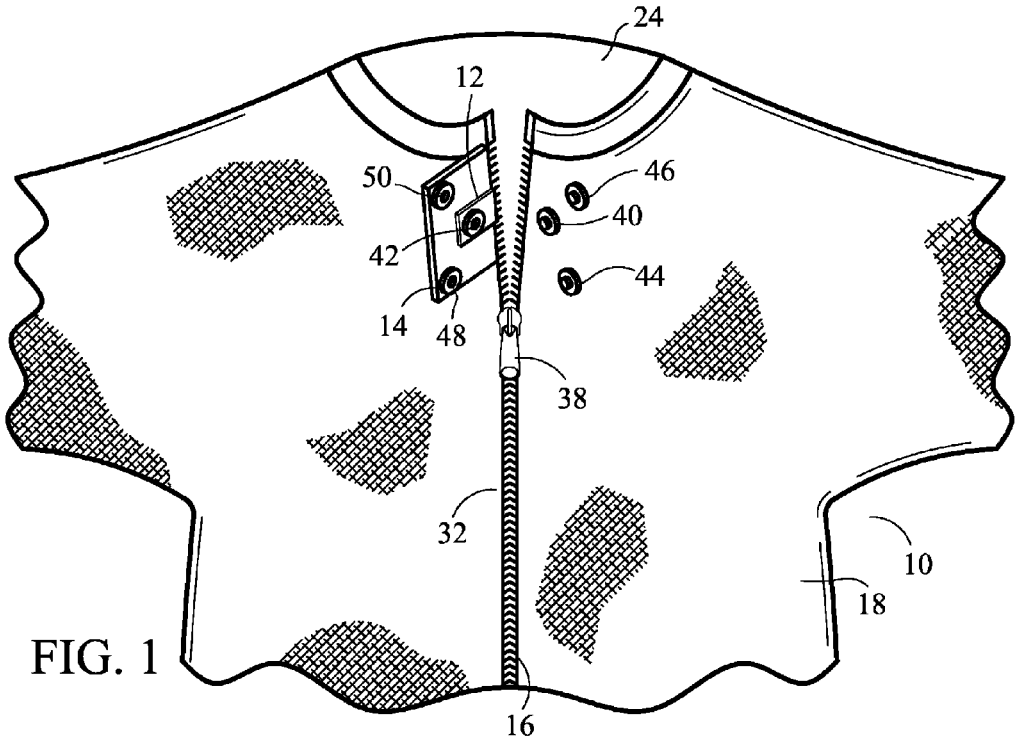
FIG. 1 is a partial rear perspective view of a removable resistant garment with unsecured zipper and safety flaps in accordance with the present invention.
Figure 2:
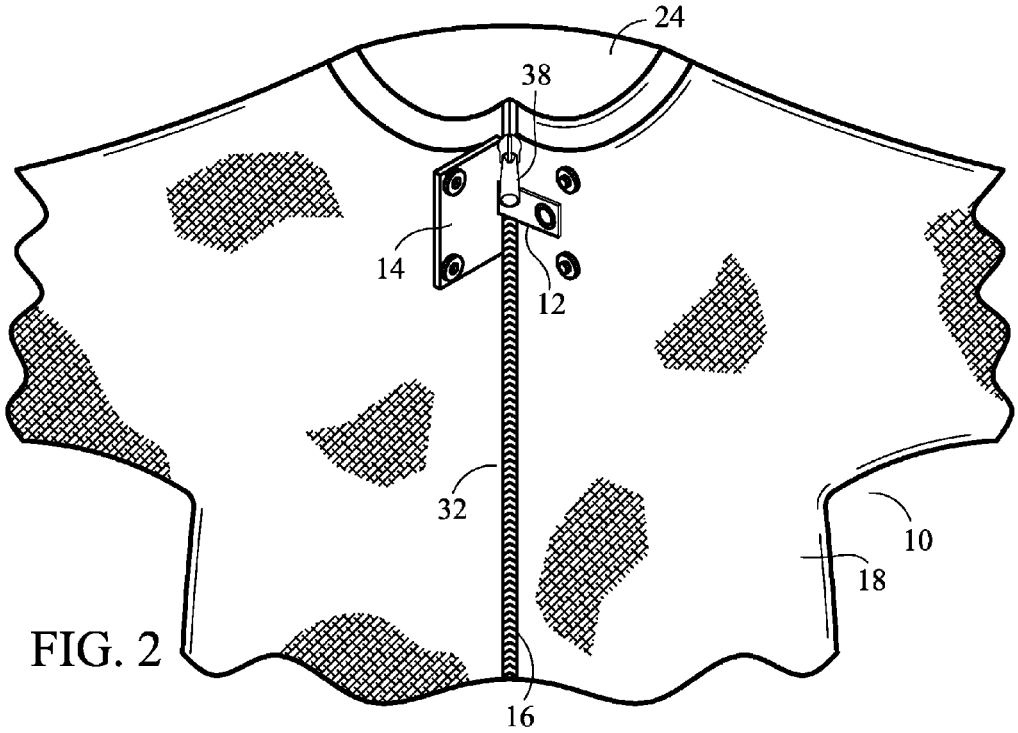
FIG. 2 is a partial rear perspective view of a removable resistant garment with a secured zipper flap and an unsecured safety flap in accordance with the present invention.
Figure 3:
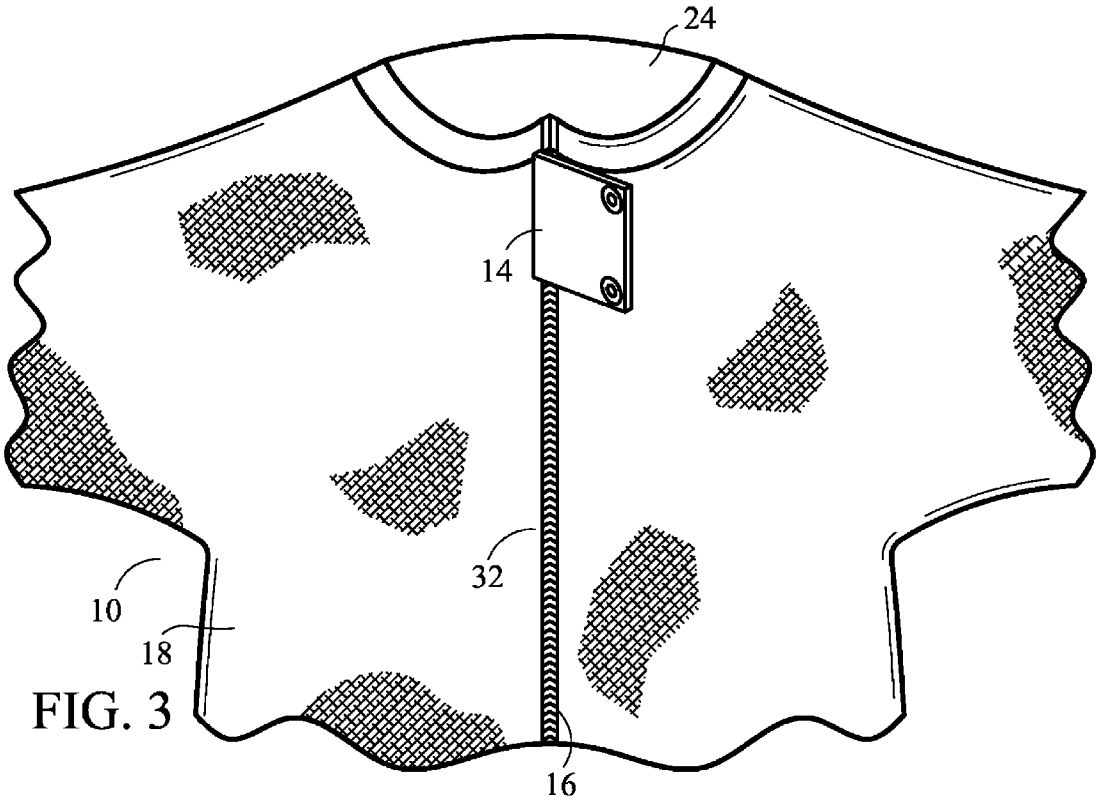
FIG. 3 is a partial rear perspective view of a removable resistant garment with secured zipper and safety flaps in accordance with the present invention.
Figure 5:
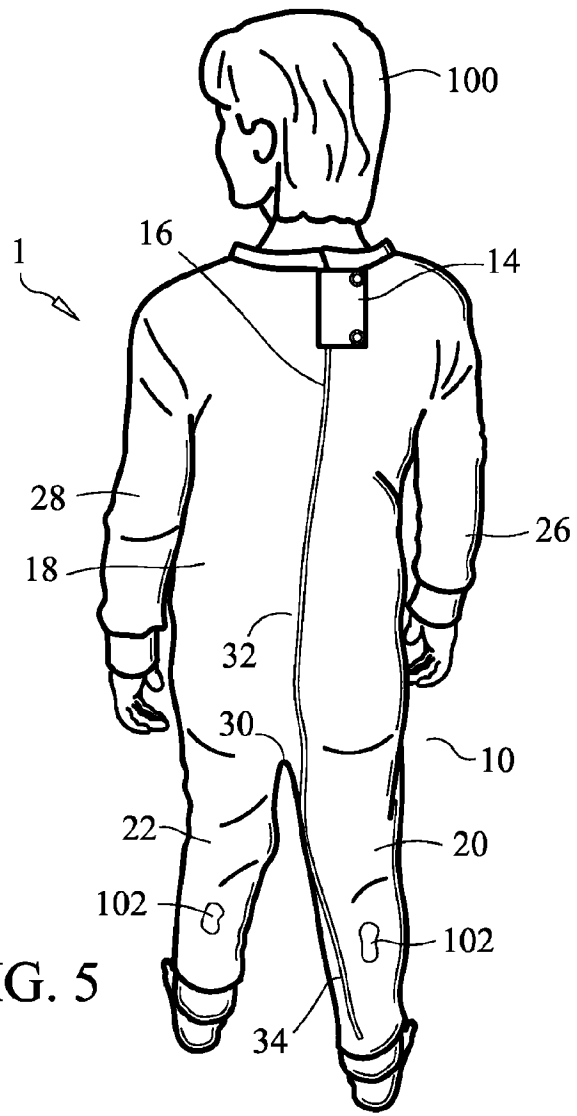
FIG. 5 is a rear perspective view of a toddler wearing a removable resistant garment in accordance with the present invention.
Figure 4:
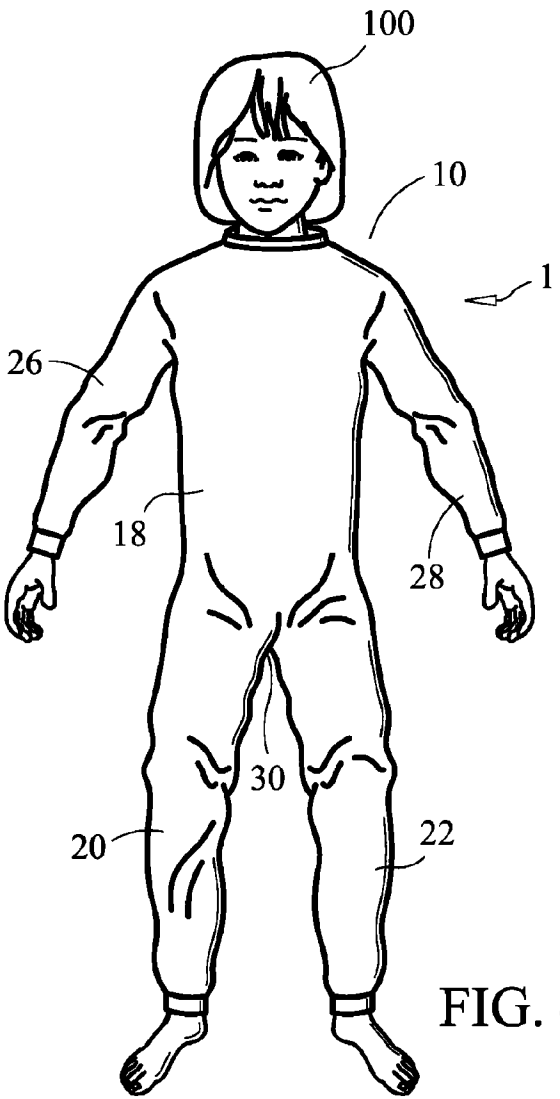
FIG. 4 is a front perspective view of a toddler wearing a removable resistant garment in accordance with the present invention.

With reference now to the drawings, and particularly to FIG. 1, there is shown a partial rear perspective view of a removable resistant garment 1. With reference to FIGS. 2-5, a removable resistant garment includes a garment 10, a zipper flap 12, a safety flap 14 and a rear mounted zipper 16. The garment 10 includes an abdomen section 18, a right leg section 20 and a left leg section 22. A neck opening 24 is formed through a top of the abdomen section 18. The right and left leg sections are shown as extending the full length of the legs 102 of the toddler 100. However, the length of left and right leg sections do not have to extend the entire length of the legs 102. The right and left leg sections extend from a bottom of the abdomen section 18. The garment 10 may also include a right arm sleeve 26 and a left arm sleeve 28. The left arm sleeve 28 extends from a left side of the garment 10, adjacent a top of the abdomen section 18 and the right arm sleeve 26 extends from a right side of the garment 10, adjacent a top of the abdomen section 18. A crouch area 30 is located between an inner surface of the left leg section, an inner surface of the right leg section and a bottom of the abdomen section 18.

A rear of the abdomen section 18 is preferably split down substantially a middle to the crouch area 30 to form an abdomen slit 32. However, the split may also extend to a bottom of end of one of the two leg sections to form a leg slit 34. The rear mounted zipper 16 is used to joint the abdomen and leg slits in the abdomen and one of the leg sections, respectively. A zipper tab 38 of the rear mounted zipper 16 is located at substantially the neck opening 24. One end of the zipper flap 12 is attached to one side of the abdomen slit 32 with sewing or the like. A first male snap 40 is secured to the other side of the abdomen slit 32. A first female snap 42 is retained in the other end of the zipper flap 12. The zipper flap 12 is located, such that a toddler 100 or other individual wearing the garment 10 will not be able to move the zipper tab 38 to unzip the rear mounted zipper 16 without detaching the zipper flap 12.

One end of a safety flap 14 is attached to the one side of the abdomen split 32 with sewing or the like. A second male snap 44 is located below the first male snap 40 and a third male snap 46 is located above the first male snap 40. A second female snap 48 and a third female snap 50 are retained in the other end of the safety flap 14, such that they engage the second and third male snaps. Satisfactory results have been found using snaps, but other removable attachment devices could be used, such as hook and loop fasteners. The safety flap 14 covers the zipper flap 12, when the snaps 44, 46, 48, 50 are engaged with each other. The safety flap 14 provides an extra barrier for preventing the wearer from taking-off the removable resistant garment 1. The safety flap 14 also makes the wearer less aware that there is a zipper tab and a zipper flap, while laying on their back.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A removable resistant garment which prevents the wearer from unzipping the rear zipper and removing the said garment comprising:

a garment including an abdomen section, a neck opening being formed through a top of said abdomen section, a neck binding, a right leg section extending from said bottom of said abdomen section, a left leg section extending from said bottom of said abdomen section;

a zipper slit being formed down the rear of said garment from the neck opening continuing through said abdomen section to a bottom of one of said left and right leg sections;

a zipper including a zipper tab for unzipping said zipper, said zipper removably joining said zipper slit;

said zipper extending from said neck opening to said bottom of one of said left and right leg sections;

a left arm sleeve extending from a left side of said abdomen section adjacent a top of said abdomen section, a right arm sleeve extending from a right side of said garment adjacent a top of said abdomen section;

a zipper flap having one end attached to one side of said zipper slit, a second end of said zipper flap being removably attachable to the other side of said zipper slit;

a cover flap having one end attached to one side of said zipper slit, a second end of said cover flap being removably attachable to the other side of said zipper slit, said cover flap completely covering said zipper flap and zipper tab when secured;

said cover flap is located to conceal a distal edge of the zipper slit at the top of the neck opening; and wherein when said zipper is fully zipped upright and said zipper flap is secured said zipper tab overlies said zipper flap which prevents the said zipper from being unzipped.

* * * * *